United States Patent [19]

Morikawa et al.

[11] Patent Number: 4,922,851

[45] Date of Patent: May 8, 1990

[54] CURTAIN COATER WITH PIVOTED STARTING PLATE

[75] Inventors: Masahiro Morikawa; Kiyoshi Kobayashi; Kimiaki Miyamoto, all of Kanagawa, Japan

[73] Assignee: Fuji Photo Film Co., Ltd., Kanagawa, Japan

[21] Appl. No.: 360,635

[22] Filed: Jun. 2, 1989

[30] Foreign Application Priority Data

Jun. 2, 1988 [JP] Japan ..... 63-135997

[51] Int. Cl.[5] ..... B04C 1/04

[52] U.S. Cl. ..... 118/324; 118/DIG. 4; 427/420

[58] Field of Search ..... 118/313–315, 118/320, 322, 324, 325, DIG. 42; 427/420

[56] References Cited

U.S. PATENT DOCUMENTS

| | | | |
|---|---|---|---|
| 3,434,457 | 3/1969 | Bass | 118/301 |
| 3,508,947 | 4/1970 | Hughes | 118/324 |
| 3,632,374 | 1/1972 | Greiller | 118/324 |
| 3,867,901 | 2/1975 | Greiller | 118/DIG. 4 |
| 3,958,532 | 5/1976 | Timson | 118/325 |
| 4,019,906 | 4/1977 | Ridley | 118/325 |
| 4,222,343 | 9/1980 | Zimmerman | 118/325 |
| 4,233,346 | 11/1980 | Kerkhofs | 118/324 |
| 4,313,980 | 2/1982 | Willemsens | 118/325 |
| 4,479,987 | 10/1984 | Koepke et al. | 118/325 |
| 4,851,268 | 7/1989 | Kozak | 118/DIG. 4 |

FOREIGN PATENT DOCUMENTS

| | | |
|---|---|---|
| 0168986 | 6/1985 | European Pat. Off. . |
| 2723444 | 5/1977 | Fed. Rep. of Germany . |
| 3241831 | 11/1982 | Fed. Rep. of Germany . |

*Primary Examiner*—Willard Hoag

*Attorney, Agent, or Firm*—Sughrue, Mion, Zinn, Macpeak & Seas

[57] ABSTRACT

A curtain-type coating liquid application device having a slide hopper and an application start plate used to prevent an increase in the thickness of the initially applied portion of the liquid on a web to thereby make the initial coating portion flat and smooth. Liquid freely falling in the form of a thin curtain from the slide hopper is caused to collide against the web continuously moving around a backup roller so that the liquid is applied to the web. The application start plate is curved or bent and is turnable about a fulcrum located under the backup roller. The application start plate also has an upper end extending at an oblique angle to the direction of width of the curtain, or it may be provided with a curtain receiving part at the upper end of the plate.

8 Claims, 4 Drawing Sheets

CURTAIN COATER WITH PIVOTED STARTING PLATE

BACKGROUND OF THE INVENTION

The present invention relates to a device for applying a composite liquid to a continuously moving web having the form of a belt-like carrier and which is used to manufacture a photographic film, photographic printing paper, a magnetic recording material such as a magnetic recording tape, an adhesive tape, information recording paper such as pressure-sensitive paper and thermosensitive paper, photographic printing plate, or the like. Particularly, the invention relates to a curtain application device employing a slide hopper.

A curtain application device employing a hopper is often used for applying a liquid to a moving web. In such a device, a freely falling curtain of a thin film of one or more kinds of liquid is made to collide against the web so that an applied liquid film is formed on the web. Curtain application devices have long been used for application to furniture, iron plating, etc.

Recently, however, curtain application devices have begun to be used in accuracy-requiring processes such as the manufacture of photographic photosensitive materials, as disclosed in the U.S. Pat. Nos. 3,508,947 and 3,632,374. It is very important for such a curtain application device to uniformly apply a freely falling curtain of a liquid to a moving web at the start of the liquid applying operation of the device. Since the speed of application by the curtain application device is required to be higher than that of an application device employing a slide hopper, the flow rate of the liquid must be made higher in the curtain application device than in the latter. For this reason, it has generally been considered that it is more difficult for a curtain application device to uniformly apply a liquid to a moving web at the start of the liquid applying operation than for a slide-hopper type device. If the liquid is not uniformly applied to the moving web at the start of the operation, problems such as contamination due to spattering of the applied liquid, contamination of a roller due to non-drying of greater thickness portions of the applied liquid downstream to a drying zone can occur, making the final product unacceptable. In the curtain application device disclosed in the U.S. Pat. No. 3,632,374, an application start plate, which is a turnable or slidable deflector, is provided which feeds a prescribed quantity of a liquid at the start of the application of the liquid to form a stable thin curtain. The excess liquid may be recovered and reused.

FIG. 10 shows a side view of the curtain application device disclosed in the U.S. Pat. No. 3,632,374. In this device, liquid 13 flows out from the interior of a slide hopper 11 to a slide surface 12 thereof, and then freely falls in the form of a thin film from the downstream end 14 of the downstream end 14 of the slide surface to form thin curtain 15, which collides against a moving web 16 so as to be applied thereto. Before the curtain 15 begins to be applied to the web 16, the application start plate 18, which is a rectangular flat plate, is in such a position as to prevent the curtain from reaching the web. The liquid first flows down onto the application start plate 18 and is gathered into a recovery vessel 21. The application start plate 18 is then turned about a fulcrum 19 so that the liquid curtain is allowed to reach the web 16, thus starting the application of the liquid curtain to the web.

Both side edges of the curtain 15 are defined by edge guides 20 extending down from the downstream end 14 of the slide hopper 11 to points which are lower than the place where the curtain reaches the web 16.

Although this application device has the advantage that the curtain 15 falling from the slide hopper 11 before the start of the application of the curtain to the web 16 is received by the application start plate 18 and then recovered by the recovery vessel 21 so as to be used again, the device has a first problem in that a large space for turning or sliding the application start plate needs to be provided in the device, a second problem in that the side edge portions of the curtain are always discarded and not applied to the web but have to be recovered for reuse, and a third problem in that, at the instant the application start plate is separated from the curtain at the start of the application thereof, the curtain is applied to the web over the entire width thereof at the same time, making the thickness of the initially applied portion of the liquid on the web larger than in other portions.

The large space, which causes the first problem, needs to be provided so as to make it possible to dispose the slide hopper 11 over the path of the moving web 16 and to make the height of the curtain 15 sufficient. If the liquid is such that the height of the curtain 15 cannot be as high as desired and it can only be made significantly less than that of the slide hopper, the hopper cannot be located over the path of the web and must be located opposite the path across the edge guides 20, making it difficult to turn the application start plate 18 as mentioned above.

The second problem is caused by the fact that the width of the application start plate 18 and the web 16 must be smaller than the distance between the two edge guides 20 so as to be able to turn the plate. If the liquid is made of a single constituent and can therefore be recovered for reuse, or if the liquid is made of plural but less expensive constituents, the application device can be economically operated If, on the other hand, the liquid is made of a large number of constituents and therefore cannot be recovered or the liquid is more expensive, the width of the curtain 15 must be decreased. In that case, the distance between the two edge guides 20 is made smaller than the width of the web 16 or a backup roller 17 so as to place the lower ends of the edge guides in positions which are higher than the line where the curtain 15 collides against the web. If the distance between the web 16 and the edge guides 20 is much increased, the width of the stream of the curtain is decreased, making the applied curtain on the web nonuniform. In that case, the application device, whose application start plate 18 is placed between the web and the guides, cannot be used for the desired applications.

The third problem is caused by liquid accumulation over the point of collision of the curtain 15 against the application start plate 18 receiving the falling curtain before the start of the application to the web 16, which tends to transfer s from the plate 18 to the web 16 at the start of application to the web 16. (See FIG. 11.)

SUMMARY OF THE INVENTION

The present invention was made in order to solve the above-mentioned problems.

Accordingly, it is an object of the present invention to provide a curtain application device which has a slide hopper and in which, even if it is not easy to form a thin curtain of a liquid, an application start plate can be effectively operated to prevent an increase in the thickness of the initially applied portion of the liquid on a web to thereby In the curtain application device provided in accordance with the present invention, liquid freely falling in the form of a thin curtain from a slide hopper is caused to collide against a web continuously moving around a backup roller so that the liquid is applied to the web. The device is characterized by the provision of an application start plate which is curved or bent and which can be turned about a fulcrum located under the backup roller or which is turnable or slidable, and which has an upper end extending at an oblique angle to the direction of width of the curtain, or which has a curtain receiving part at the upper end of the plate.

DESCRIPTION OF THE PREFERRED EMBODIMENTS

Figure 1:
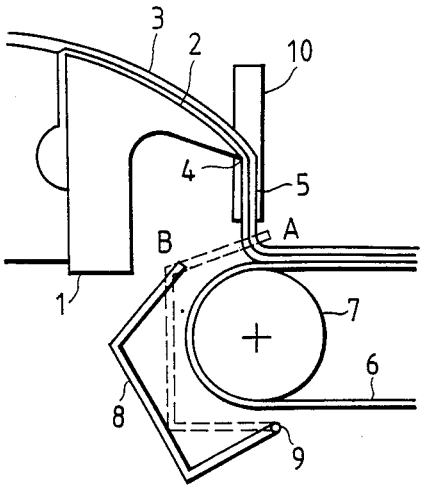
FIG. 1 shows a side view of an application device of a preferred embodiment of the present invention having a bent application start plate.
Figure 2:
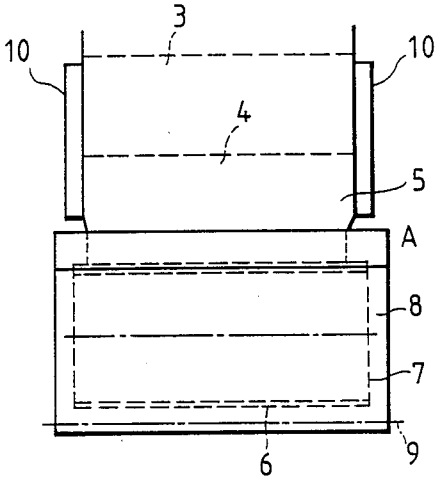
FIG. 2 shows a front view of the application device of FIG. 1.

FIG. 1 shows a side view of an application device constructed according to a preferred embodiment of the present invention. FIG. 2 shows a front view of the application device of FIG. 1.

A liquid 3 to be applied flows out from the interior of a slide hopper 1 onto the slide surface 2 thereof and then freely falls in the form of a thin curtain 5 from the downstream end 4 of the slide surface. Before the thin curtain 5 of the liquid begins to be applied to a moving web 6, the upper end of an application start plate 8 is placed in a position A so as to prevent the curtain from reaching the web. The application start plate 8 is curved or bent such that it surrounds a backup roller 7. The lower end of the plate 8 is pivotally coupled to a fulcrum 9 under the nearby backup roller 7. Both side edges of the curtain 5 are defined by edge guides 10 extending from the downstream end 4 of the slide surface 2 to the vicinity of the upper end of the area where the curtain collides against the moving web 6.

When the curtain 5 begins to be applied to the moving web 6, the application start plate 8 is turned downward about the fulcrum 9 so that the upper end of the plate is moved away from the position A into another position B. As a result, the curtain 5 is allowed to reach the moving web 6. Since the application start plate 8 is turned downward about the fulcrum 9 under the backup roller 7 so that the upper end of the plate is moved down along the peripheral surface of the roller, the turning of the plate is not hindered although the distance between the web 6 and the edge guides 10 is small and the space between the slide hopper 1 and the backup roller is narrow.

Although in the above embodiment the fulcrum 9 is located under the backup roller 7, the fulcrum is not confined to such a location but may be such that shafts are provided at the sides of the application device near the axis of rotation of the backup roller to reduce the radius of turning of the application start plate 8. It will be understood that the application device can be also applied to the case where the height of the curtain is made large, due to the ease of generation of the curtain, or the distance between the web and the edge guides is made large.

Figure 3A:
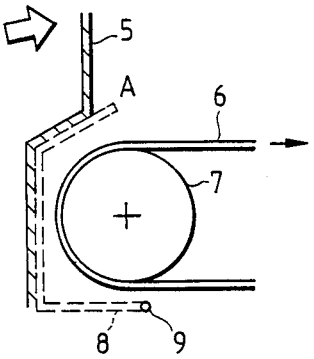
FIGS. 3A–3C are cross-sectional side views showing the turning of the application start plate after the movement of a slide hopper for the start of application of liquid to the web.
Figure 3B:
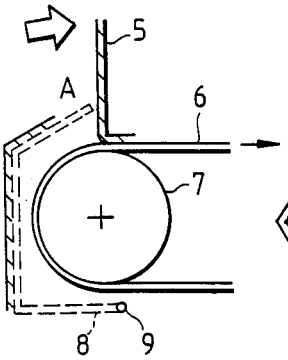
Figure 3C:
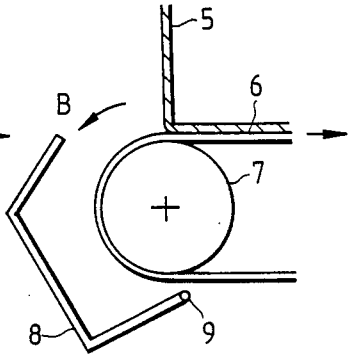

FIG. 3 shows an application device which is a modification of the embodiment shown in FIGS. 1 and 2. Before a thin curtain 5 of liquid begins to be applied to a moving web 6 by the application device shown in FIG. 3, the liquid is made to flow onto an application start plate 8 at a prescribed position so that the liquid is recovered, as shown in FIG. 3A. When the curtain 5 begins to be applied to the moving web 6, a slide hopper 1 is moved toward a backup roller 7 while the application start plate 8 remains in the prescribed position so that the curtain 5 falls in front of the upper end of the application start plate and reaches the moving web 6, as shown in FIG. 3B. After the application of the curtain 5 to the moving web 6 is thus started, the application start plate 8 is turned downward, as shown in FIG. 3C. Although the curtain 5 is likely to be pulled by the turned application start plate 8 so that the initially applied portion of the liquid on the web 6 is made irregular in the application device shown in FIGS. 1 and 2 and in which the slide hopper 1 is held in a fixed position, such likelihood is prevented in the device of FIGS. 3A–3C.

Figure 4:
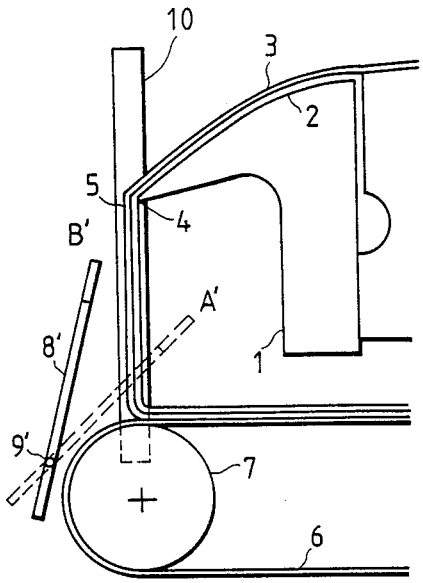
FIG. 4 shows a side view of an application device of another embodiment of the present application having an application start plate whose upper end is arranged at an oblique angle to the direction of width of the thin curtain of liquid to be applied; liquid to be applied.
Figure 5:
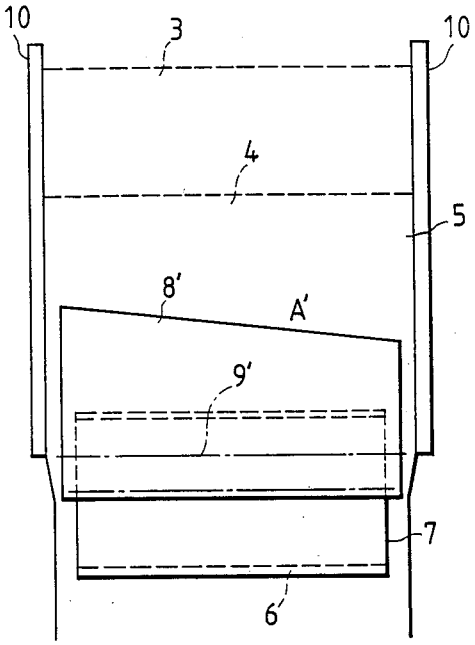
FIG. 5 shows a front view of the application device shown in FIG. 4.

FIG. 4 shows a side view of an application device constructed according to another embodiment of the present invention. FIG. 5 shows a front view of the application device of FIG. 4.

Figure 6A:
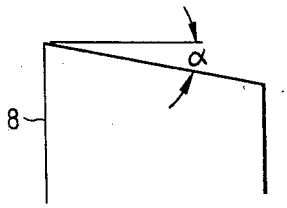
FIGS. 6A–6C show examples of the oblique upper end of the application start plate shown in FIG. 4.
Figure 6B:
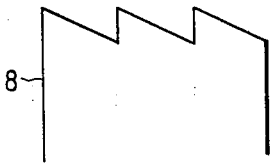
Figure 6C:
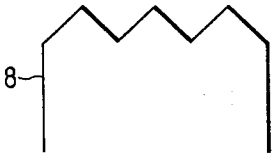

The application start plate 8, of the device is a flat plate, but the upper end of the plate extends at an oblique angle to the direction of width of a thin curtain 5 of liquid. Before the curtain 5 begins to be applied to the moving web 6, the upper end of the application start plate 8' is placed in a position A' so as to prevent the curtain from reaching the web. When the curtain 5 begins to be applied to the moving web 6, the application start plate 8' is turned so that the upper end thereof is moved away from the position A' into another position B, and the plate is completely separated from the curtain. At that time, the curtain 5 gradually moves from the application start plate 8' to the moving web 6 along the width of the plate due to the oblique angle of the upper end thereof to the direction of width of the curtain. As a result, the thickness of the initially applied portion of the liquid on the web is much less likely to become larger than that of other portions. The oblique angle $\alpha$ of the upper end of the application start plate 8' relative to the direction of width of the curtain 5 is 1° to 30°, preferably 2° to 10°. Although the upper end of the application start plate 8' is straight as shown in FIG. 6A, the upper end is not confined to such a shape, and it may have a sawtooth shape as shown in FIG. 6B or a zigzag shape as shown in FIG. 6C, and the constituent lines of the sawtooth-shaped or zigzag-shaped upper end may be either straight or curved. The application start plate 8' may be translated instead of being turned to move the upper end thereof out of the position A' into the other position B'.

The application device shown in FIGS. 1 and 2 may be modified so that the upper curved or bent end of the application start plate 8 extends at an oblique angle to the direction of width of the curtain 5, as shown in FIGS. 4 and 5, to gradually move the curtain from the application start plate to the moving web 6 along the width of the curtain to prevent a partial increase in the thickness of the applied liquid on the web and thus to make the surface of the applied liquid thereon flat and smooth.

Figure 7:
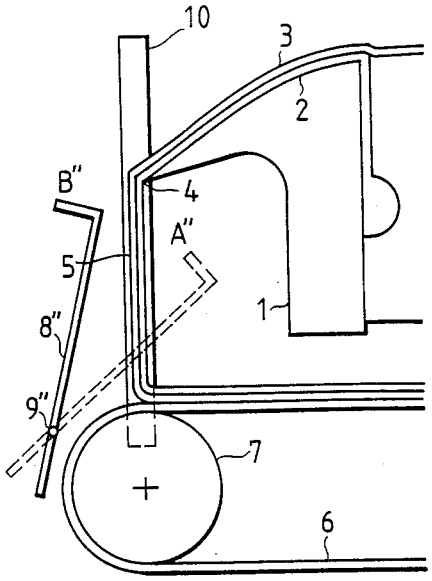
FIG. 7 shows a side view of an application device of yet another embodiment of the present invention having an application start plate having a curtain receiving part at the upper end of the plate.
Figure 8:
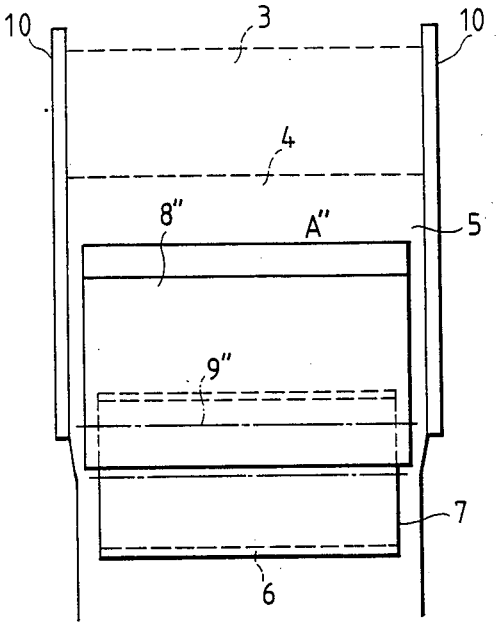
FIG. 8 shows a front view of the application device shown in FIG. 7.

FIG. 7 shows a side view of an application device of yet another embodiment of the present invention FIG. 8 shows a front view of the application device of FIG. 7.

Figure 9A:
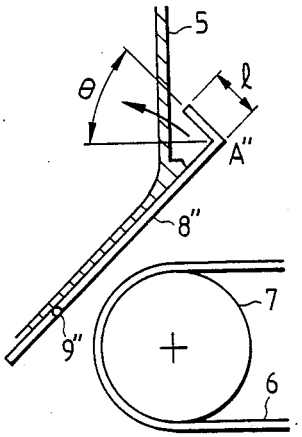
FIGS. 9A–9C are cross-sectional side views showing how to use the curtain receiving part to begin application of liquid to the web.
Figure 9B:
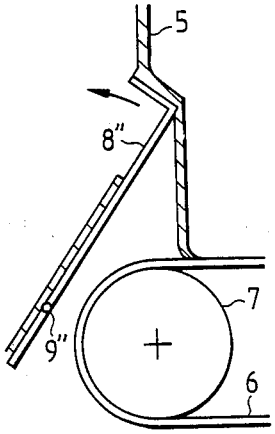
Figure 9C:
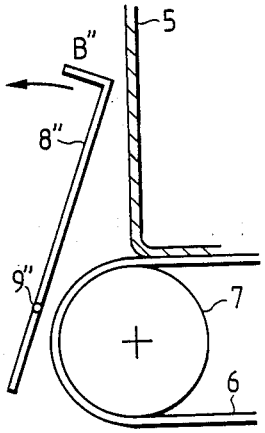

The application start plate 8'' of the device is bent in an L-shape so that the plate has a curtain receiving part at the upper end of the plate. When a thin curtain 5 of a liquid begins to be applied to a moving web 6 by the application device, the application start plate 8'' is turned so that the upper end thereof is moved away from such a position A'' so as to prevent the curtain from reaching the web, and is then moved into such a position B'' so as to allow the curtain to reach the web. At that time, the curtain 5 changes from a state of colliding against the application start plate 8'' under the curtain receiving part thereof, as shown in FIG. 9A, into a state of colliding against the curtain receiving part and falling onto the moving web 6, as shown in FIG. 9B. Subsequently, the plate 8 is turned further so. that the plate is separated from the curtain 5 to allow it to directly reach the moving web 6, as shown in FIG. 9C. Since the curtain 5 is received by the curtain receiving part and then reaches the moving web 6 at the start of the application of the curtain thereto, liquid accumulation is prevented from affecting the thickness of the applied liquid on the web as in the conventional application device described above. The thickness of the initially applied portion of the liquid on the web 6 is thus made much less likely to become larger than that of other portions. The width l of the curtain receiving part is 2 mm to 10 mm, preferably 3 mm to 5 mm. The angle $\theta$ of the part to the horizontal plane is 20° to 90°, preferably 40° to 60°.

The application device shown in FIGS. 1 and 2 may be modified so that the curved or bent application start plate 8 has a curtain receiving part at the upper end of the plate, as shown in FIGS. 7 and 8, so as to cause the curtain 5 to be received by that part and then to fall onto the moving web 6 at the start of the application of the curtain, thereto to prevent an increase in the thickness of the applied liquid onto the web and thus making the surface of the applied liquid flat and smooth.

The construction of the application device shown in FIGS. 7 and 8 may be combined with that of the application device shown in FIGS. 4 and 5 to apply a thin curtain of liquid to a moving web similarly to the operation shown in FIG. 3. Also, the construction of the application device shown in FIGS. 1 and 2 may be combined with that of the application device shown in FIGS. 4 and 5 to apply a thin curtain of a liquid to a moving web similarly to the operation shown in FIG. 3.

The liquid to be applied in the form of the thin curtain 5 to the moving web 6 by each of the application devices described above may contain various substances, such as those for a photosensitive emulsion layer, an undercoating layer, a protective layer or a back layer of a photographic photosensitive material, those for a magnetic layer, an undercoating layer, a lubricant layer, a protective layer or a backing layer of a magnetic recording material, those for a microcapsule layer or a color developer layer on an information recording layer of a photographic printing plate.

The web 6 to which the curtain 5 is applied by each of the above application devices may be paper, a plastic film, a metal sheet, resin-coated paper, synthetic paper or the like. For example, the plastic film may be made of a polyolefin such as polyethylene or polystyrene, a vinyl polymer, a polyamide such as 6,6-nylon or 6-nylon, a polyester such as polyethylene terephthalate or polyethylene 2,6-naphthalate, polycarbonate, or a cellulose acetate such as cellulose triacetate or cellulose diacetate. The resin for the resin-coated paper may be a polyolefin such as polyethylene. The surface of the resin-coated paper may be embossed or not. Embossment is not confined to any particular form. The metal sheet may be an aluminum sheet, for example.

Actual examples of embodiments of the present invention are hereafter described to clarify the effects of the invention.

EXAMPLE 1

A thin curtain of a liquid was applied to a moving web by an application device constructed as shown in FIGS. 1 and 2. The liquid was prepared by adding 1.5 g/l of an anionic surface active agent together with a blue dye to an aqueous solution of 10.0% by weight of an alkali-treated gelatin of a type typically used in photographic applications. The viscosity of the liquid was 0.48 poise at a temperature of 40° C. The liquid was 0.48 poise at a temperature of 40° C. The liquid of the curtain flowed at a rate of 4.0 ml/cm-sec over the width of the web, which moved at a speed of 200 m/min in the longitudinal direction thereof and was coated with gelatin in advance. The height of the curtain was 100 mm. The distance between the web and the lower ends of the edge guides 10 was 10 mm. Before the curtain began to be applied to the moving web, the upper end of the application start plate 8 was located at a distance 5 mm up from the web. When the curtain began to be applied to the moving web, the application start plate 8 was turned downward so that the upper end thereof was moved out of the position A into the other position B. As a result, the curtain was stably applied to the moving web.

EXAMPLE 2

A thin curtain of liquid was applied to a moving web by the application device shown in FIG. 3. The liquid and the conditions of the application were the same as those in Example 1. When the curtain began to be applied to the moving web, the slide hopper 1 was moved and the application start plate 8 remained at a standstill.

After the curtain began to be applied to the moving web, the application start plate 8 was turned downward. As a result, the curtain was stably applied to the moving web.

EXAMPLE 3

A thin curtain of liquid was applied to a moving web by the application device shown in FIGS. 4 and 5. The liquid and the conditions of application were the same as those in Example 1. The oblique angle $\alpha$ of the upper end of the application start plate 8' to the direction of width of the curtain was 5°. As a result, the thickness of the initially applied portion of the liquid on the web was scarcely larger than that of the other portions of the liquid coated thereon. Therefore, the quality of the applied liquid on the web was good.

Figure 10:
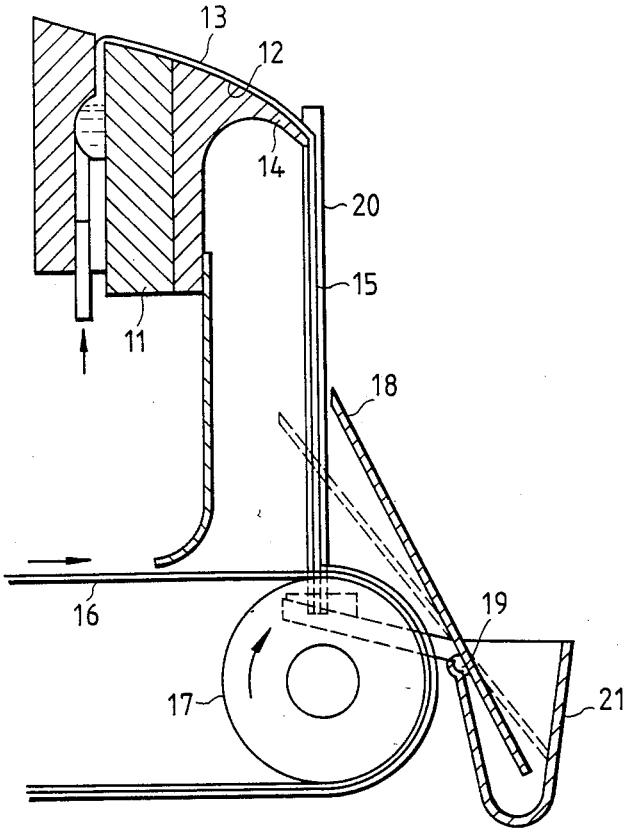
FIG. 10 shows a side view of a conventional application device.
Figure 11:
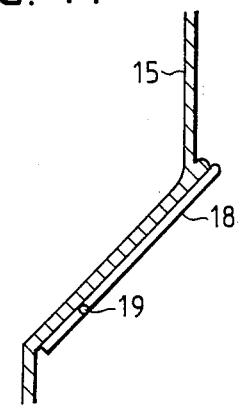
FIG. 11 shows liquid accumulation on the application start plate of the conventional application device.

For comparison with Example 3, the curtain was applied to the moving web using an application start plate whose upper end extended parallel to the direction of width of the curtain as shown in FIG. 10. In that case, the thickness of the initially applied portion of the liquid on the web became larger than that of the other portions.

EXAMPLE 4

A thin curtain of liquid was applied to a moving web by an application device constructed as shown in FIGS. 7 and 8. The liquid and the conditions of the application were the same as those in Example 1. Before the curtain began to be applied to the moving web, the upper end of the application start plate 8" was located in the position A" and the angle of the curtain receiving part of the application start plate to the horizontal plane was 60°. The width l of the curtain receiving part was 5 mm. As a result, the thickness of the initially applied portion of the liquid on the web was equal to that of the other portions of the applied liquid. Therefore, the quality of the applied liquid on the web was good. For comparison with Example 4, the curtain was applied to the moving web using an application start plate which was flat as shown in FIG. 10. In that case, the thickness of the initially applied portion of the liquid on the web was larger than that of other portions.

According to the present invention, an application device is provided in which a liquid freely falling in the form of a thin curtain from a hopper is caused to collide against a continuously moving web so as to be applied to the web, the device having an application start plate which is turnable or slidable. The application start plate is pivotally coupled to a fulcrum under a nearby backup roller and is curved or bent. The upper end of the plate extends at an oblique angle to the direction of the width of the curtain of liquid. The plate is bent in an L-shape so as to have a liquid receiving part at the upper end of the plate. Otherwise, the plate may have a combination of such conditions.

This results in producing effects as follows:

1. Even if it is difficult due to the properties of the liquid to generate a thin curtain of the liquid, or a large space as is necessary for the application start plate of a conventional application device is not available, the application start plate can nevertheless be effectively operated to stably apply a curtain of the liquid to the moving web.

2. The thickness of the initially applied portion of the liquid on the web is equal to that of other portions. As a result, the energy and time required for drying the liquid applied to the web are reduced, and the applied liquid is prevented from remaining partially undried, which would lead to contamination of other members.

What is claimed is:

1. In a liquid application device having a turnable application start plate, and wherein a liquid freely falling in the form of a thin curtain from a hopper is caused to collide against a web continuously moving around a backup roller so that said liquid is applied to said web, the improvement wherein said plate is curved or bent, and a fulcrum for turning said plate is located under said roller.

2. The liquid application device according to claim 1, wherein said application start plate has a curtain receiving part.

3. The liquid application device according to claim 1, wherein an upper end of said application start plate extends at an oblique angle to a direction of width of said thin curtain.

4. The liquid application device according to claim 3, wherein said application start plate has a curtain receiving part.

5. In a liquid application device having a turnable or slidable application start plate, and wherein a liquid freely falling in the form of a thin curtain from a hopper is caused to collide against a web continuously moving around a backup roller so that said liquid is applied to said web, the improvement wherein an upper end of said plate extends at an oblique angle to a direction of width of said curtain.

6. The liquid application device according to claim 5, wherein said application start plate has a curtain receiving part.

7. In a liquid application device having a turnable or slidable application start plate, and a liquid freely falling in the form of a thin curtain from a hopper is caused to collide against a web continuously moving around a backup roller so that said liquid is applied to said web, the improvement wherein said plate has a curtain receiving part at an upper end of said plate.

8. The liquid application device according to claim 7, wherein a width of said curtain receiving part is in a range of 2 mm to 10 mm.

* * * * *